US010431404B1

(12) United States Patent
Lin

(10) Patent No.: US 10,431,404 B1
(45) Date of Patent: Oct. 1, 2019

(54) LINKAGE ASSEMBLY AND KEY SWITCH DEVICE HAVING THE SAME

(71) Applicant: Sunrex Technology Corp., Taichung (TW)

(72) Inventor: Shih-Pin Lin, Taichung (TW)

(73) Assignee: SUNREX TECHNOLOGY CORP., Taichung (TW)

( * ) Notice: Subject to any disclaimer, the term of this patent is extended or adjusted under 35 U.S.C. 154(b) by 0 days.

(21) Appl. No.: 16/111,682

(22) Filed: Aug. 24, 2018

(30) Foreign Application Priority Data

Apr. 24, 2018 (TW) ..... 107113869 A

(51) Int. Cl.
*H01H 13/14* (2006.01)
*H01H 13/52* (2006.01)

(52) U.S. Cl.
CPC ..... *H01H 13/14* (2013.01); *H01H 13/52* (2013.01); *H01H 2221/058* (2013.01); *H01H 2233/07* (2013.01)

(58) Field of Classification Search
CPC .. H01H 13/14; H01H 13/52; H01H 2221/058; H01H 2233/07
USPC ..... 200/5 A, 337
See application file for complete search history.

(56) References Cited

U.S. PATENT DOCUMENTS

2006/0000694 A1* 1/2006 Nishino ..... H01H 3/122 200/5 A
2011/0056818 A1* 3/2011 Maruyama ..... H01H 3/122 200/5 A
2017/0243704 A1* 8/2017 Lin ..... H01H 13/14

FOREIGN PATENT DOCUMENTS

| | | | |
|---|---|---|---|
| CN | 104979123 | A | 10/2015 |
| CN | 107978468 | A | 5/2018 |
| CN | 208173436 | U | 11/2018 |
| TW | 201712712 | A | 4/2017 |

OTHER PUBLICATIONS

Search Report appended to an Office Action issued to Taiwanese counterpart application No. 107113869 by the TIPO dated Sep. 5, 2018.
Search Report appended to an Office Action issued to Chinese counterpart application No. 201810474901.2 by the CNIPA dated Mar. 5, 2019, with an English translation thereof.

* cited by examiner

*Primary Examiner* — Edwin A. Leon
*Assistant Examiner* — Iman Malakooti
(74) *Attorney, Agent, or Firm* — Husch Blackwell LLP

(57) ABSTRACT

A linkage assembly is provided for guiding movement of a key cap relative to a support board. The linkage assembly includes left and right modular linking members, and a pair of synchronizing units each including a left upper cavity, a left lower cavity, a right upper cavity, and a right lower cavity. In a normal position of the key cap, a left downward abutment region of the left lower cavity is in frictional engagement with a right upward abutment region of the right upper cavity. In a pressed position of the key cap, a left upward abutment region of the left upper cavity is in frictional engagement with a right downward abutment region of the right lower cavity.

12 Claims, 17 Drawing Sheets

LINKAGE ASSEMBLY AND KEY SWITCH DEVICE HAVING THE SAME

CROSS-REFERENCE TO RELATED APPLICATION

This application claims priority from Taiwanese invention patent application no. 107113869, filed on Apr. 24, 2018.

FIELD

The disclosure relates to a linkage assembly, more particularly to a key switch device having the linkage assembly.

BACKGROUND

The applicant of this application had disclosed a linkage mechanism in U.S. 2017/0243704 A1. The linkage mechanism includes a left wing having two left arms, two left supporting rods that are respectively formed on the left arms, and two left sliding rods that are respectively formed on the left arms, a right wing having two right arms, two right supporting rods that are respectively formed on the right arms, and two right connecting rods that are respectively formed on the right arms, and a hinge unit having two left hinge pins, two right hinge pins, two left hinge holes and two right holes. Each left hinge hole is formed in a respective left arm and is engaged with a respective right hinge pin. Each right hinge hole is formed in a respective right arm and is engaged with a respective left hinge pin.

SUMMARY

An object of the disclosure is to provide a novel linkage assembly and a key switch device having the linkage assembly.

According to a first aspect of the disclosure, a linkage assembly is for guiding movement of a key cap in an upright direction relative to a support board between a normal position, where the key cap is distal from the support board, and a pressed position, where the key cap is proximate to the support board. The linkage assembly includes a left modular linking member, a right modular linking member, and a pair of synchronizing units. The left modular linking member includes a pair of left arms and a left crosspiece. The left arms are spaced apart from each other in a front-to-rear direction. Each of the left arms extends in a left-to-right direction and includes a left power segment, a left weight segment, and a left fulcrum area. The left power segment is configured for pivotally coupling with the key cap so as to move therewith in the upright direction. The left weight segment is disposed rightwardly of the left power segment, and has a first left sub-segment, and a second left sub-segment opposite to the first left sub-segment in the front-to-rear direction. The left fulcrum area is disposed between the left weight segment and the left power segment, and is configured for pivotally coupling to the support board about a first moving axis in the front-to-rear direction, such that in response to downward movement of the key cap from the normal position to the pressed position, the left weight segment is moved angularly and upwardly about the first moving axis, and such that in response to upward movement of the key cap from the pressed position to the normal position, the left weight segment is moved angularly and downwardly about the first moving axis. The left crosspiece extends in the front-to-rear direction to interconnect the left power segments of the left arms. The right modular linking member includes a pair of right arms and a right crosspiece. The right arms are spaced apart from each other in the front-to-rear direction. Each of the right arms extends in the left-to-right direction and includes a right power segment, a right weight segment, and a right fulcrum area. The right power segment is configured for pivotally coupling to the key cap so as to move therewith in the upright direction. The right weight segment is disposed leftwardly of the right power segment, and has a first right sub-segment, and a second right sub-segment opposite to the first right sub-segment in the front-to-rear direction. The right fulcrum area is disposed between the right weight segment and the right power segment, and is configured for pivotally coupling to the support board about a second moving axis parallel to the first moving axis, such that in response to the downward movement of the key cap, the right weight segment is moved angularly and upwardly about the second moving axis, and such that in response to the upward movement of the key cap, the right weight segment is moved angularly and downwardly about the second moving axis. The right crosspiece extends in the front-to-rear direction to interconnect the right power segments of the right arms. The synchronizing units are configured to couple the left weight segments of the left arms respectively to the right weight segments of the right arms so as to synchronize movement of each of the left arms and a corresponding one of the right arms. Each of the synchronizing units includes a left upper cavity, a left lower cavity, a right upper cavity, and a right lower cavity. The left upper cavity is formed in and extends from an upper surface of the first left sub-segment to terminate at a left upward abutment region. The left lower cavity is formed in and extends from a lower surface of the second left sub-segment to terminate at a left downward abutment region. The right upper cavity is formed in and extends from an upper surface of the first right sub-segment to terminate at a right upward abutment region confronting the left downward abutment region. The right lower cavity is formed in and extends from a lower surface of the second right sub-segment to terminate at a right downward abutment region confronting the left upward abutment region such that in response to the downward movement of the key cap, the left upward abutment region is brought into frictional engagement with the right downward abutment region to thereby retain the key cap in the pressed position, and such that in response to the upward movement of the key cap, the left downward abutment region is brought into frictional engagement with the right upward abutment region to thereby retain the key cap in the normal position.

According to a second aspect of the disclosure, a key switch device includes a key cap, a support board, and the linkage assembly.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

Figure 1:
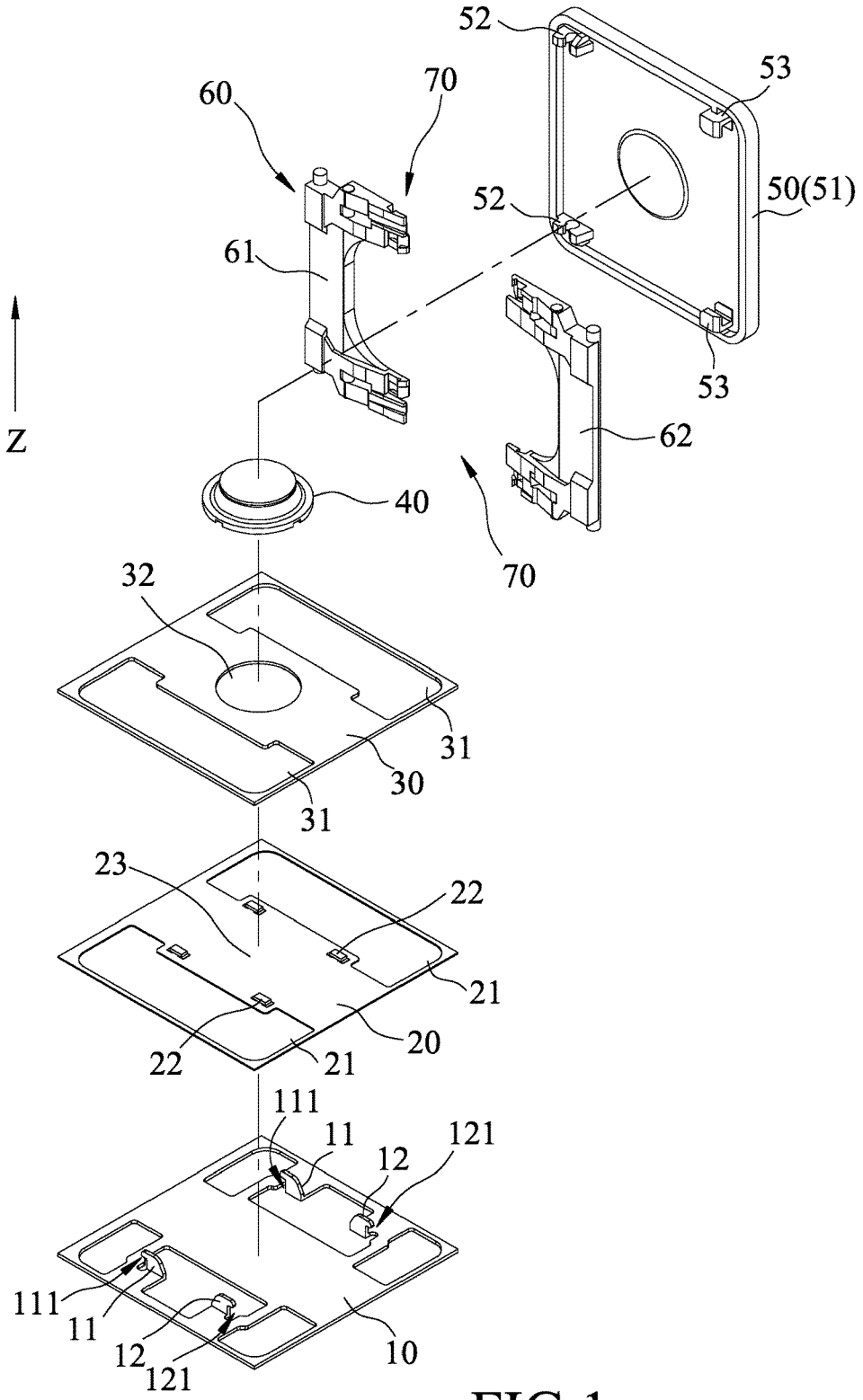
FIG. 1 is an exploded perspective view of a key switch device according to a first embodiment of the disclosure.

Before the disclosure is described in greater detail, it should be noted that where considered appropriate, reference numerals have been repeated among the figures to indicate corresponding or analogous elements, which may optionally have similar characteristics.

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Referring to FIGS. 1 to 6, a key switch device according to a first embodiment of the disclosure is shown to include a key cap 50, a support board 10, and a linkage assembly 60 for guiding movement of the key cap 50 in an upright direction (Z) relative to the support board 10 between a normal position (FIG. 5), where the key cap 50 is distal from the support board 10, and a pressed position (FIG. 6), where the key cap 50 is proximate to the support board 10.

In an embodiment shown in FIG. 1, the key cap 50 includes a cap body 51, a pair of left hingeably retaining members 52 formed on a lower surface of the cap body 51, and a pair of right hingeably retaining members 53 formed on the lower surface of the cap body 51.

In an embodiment shown in FIG. 1, the support board 10 includes a pair of left slidably retaining members 11 and a pair of right slidably retaining members 12. The left and right slidably retaining members 11, 12 are respectively formed by punching the support board 10 so as to have left and right retaining portions 111, 121.

Figure 2:
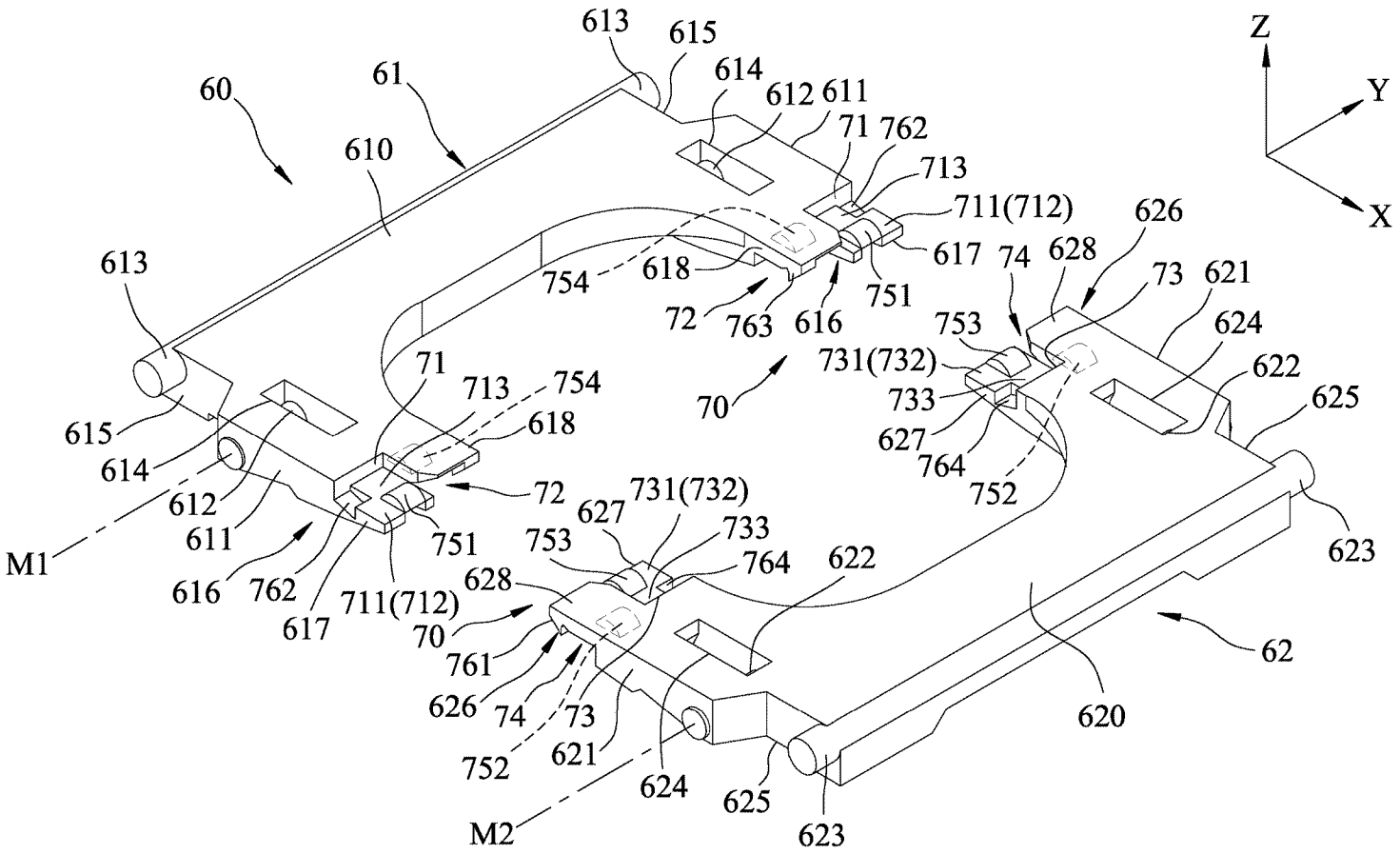
FIG. 2 is an enlarged perspective view of left and right modular linking members of the key switch device.

As shown in FIG. 2, the linkage assembly 60 includes a left modular linking member 61, a right modular linking member 62, and a pair of synchronizing units 70.

The left modular linking member 61 includes a pair of left arms 611 and a left crosspiece 610.

The left arms 611 are spaced apart from each other in a front-to-rear direction (Y). Each of the left arms 611 extends in a left-to-right direction (X) and includes a left power segment 615, a left weight segment 616, and a left fulcrum area 612 disposed between the left weight segment 616 and the left power segment 615.

The left power segment 615 is configured for pivotally coupling with the key cap 50 so as to move therewith in the upright direction (Z). In an embodiment shown in FIGS. 1 and 2, the left power segment 615 is formed with a left retained finger 613 configured to be hingeably retained by a respective one of the left hingeably retaining members 52.

The left weight segment 616 is disposed rightwardly of the left power segment 615, and has a first left sub-segment 617, and a second left sub-segment 618 opposite to the first left sub-segment 617 in the front-to-rear direction (Y).

The left fulcrum area 612 is configured for pivotally coupling to the support board 10 about a first moving axis (M1) in the front-to-rear direction (Y). In response to downward movement of the key cap 50 from the normal position (FIG. 5) to the pressed position (FIG. 6), the left weight segment 616 is moved angularly and upwardly about the first moving axis (M1). In response to upward movement of the key cap 50 from the pressed position (FIG. 6) to the normal position (FIG. 5), the left weight segment 616 is moved angularly and downwardly about the first moving axis (M1).

Figure 3:
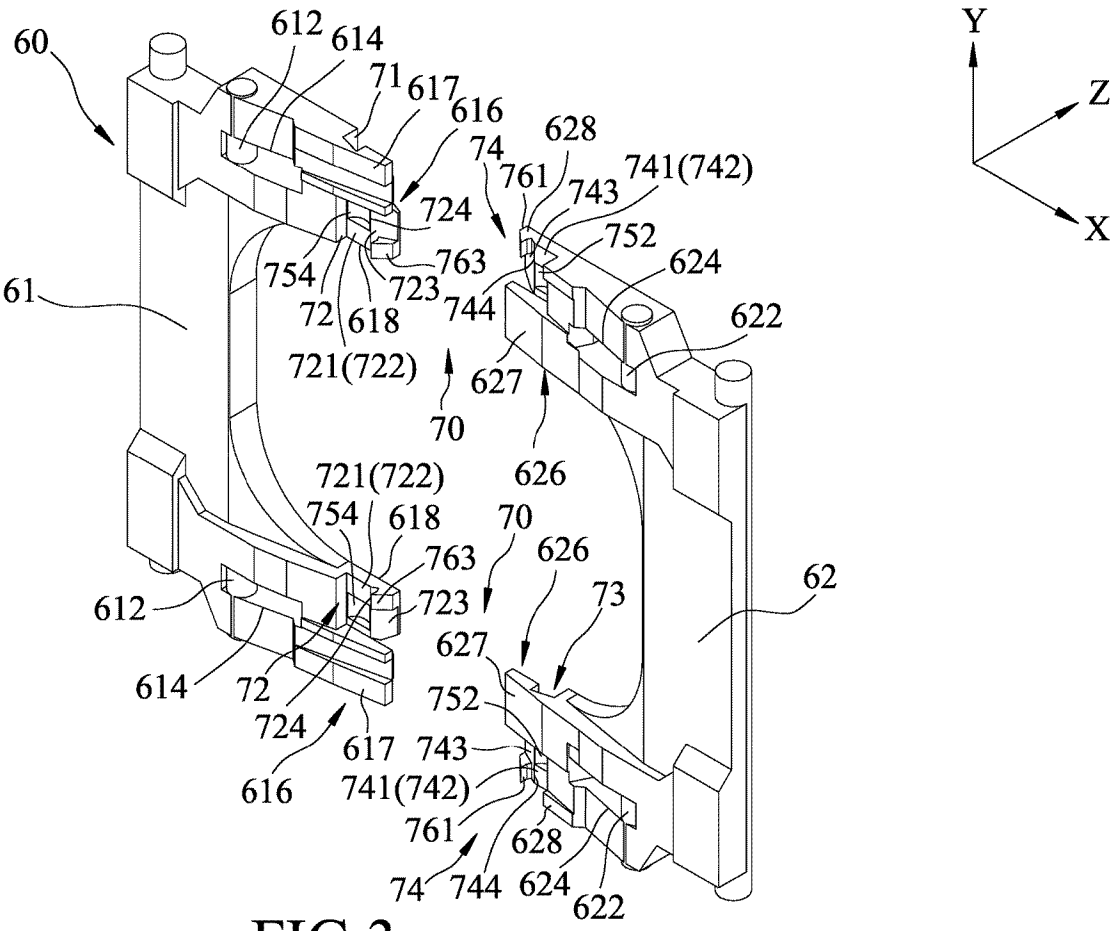
FIG. 3 is similar to FIG. 2 but illustrating the bottoms of the left and right modular linking members.
Figure 4:
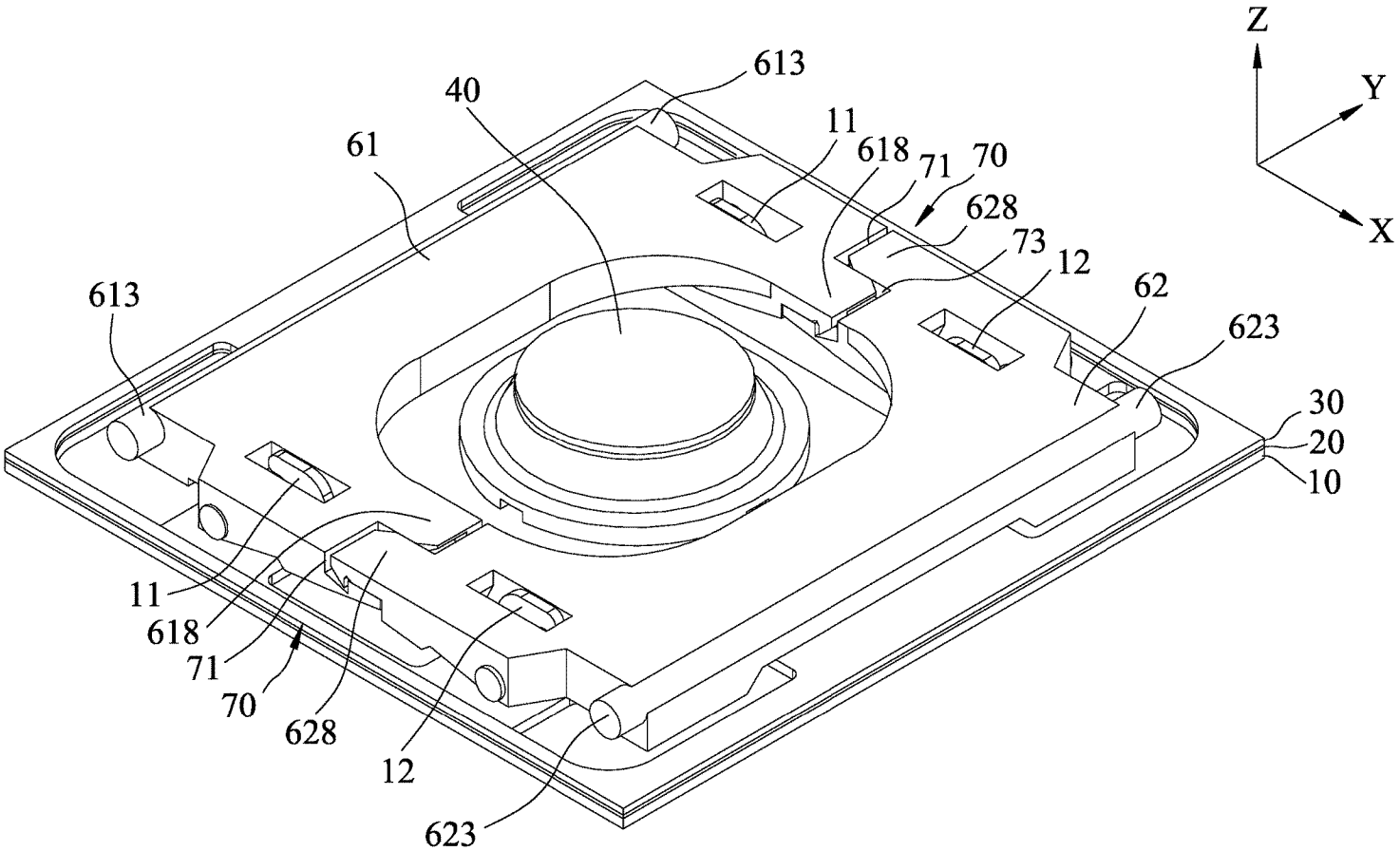
FIG. 4 is a perspective view of the key switch device of FIG. 1 in an assembled state, in which a key cap is omitted.

In an embodiment shown in FIGS. 2 and 3, the left fulcrum area 612 is disposed in a left through bore 614 which is formed in a respective one of the left arm 611, and which is configured to receive a respective one of the left slidably retaining members 11 shown in FIG. 1.

In other embodiments, the left fulcrum area 612 may be formed on an outer peripheral surface of a left fulcrum pin (not shown), and the left fulcrum pin may extend from an outboard of a corresponding one of the left arms 611 in the front-to-rear direction (Y).

The left crosspiece 610 extends in the front-to-rear direction (Y) to interconnect the left power segments 615 of the left arms 611.

Further referring to FIG. 2, the right modular linking member 62 is shown to include a pair of right arms 621 and a right crosspiece 620.

The right arms 621 are spaced apart from each other in the front-to-rear direction (Y). Each of the right arms 621 extends in the left-to-right direction (X) and includes a right power segment 625, a right weight segment 626, and a right fulcrum area 622 disposed between the right weight segment 626 and the right power segment 625.

The right power segment 625 is configured for pivotally coupling to the key cap 50 so as to move therewith in the upright direction (Z). In an embodiment shown in FIGS. 1 and 2, the right power segment 625 is formed with a right retained finger 63 configured to be hingeably retained by a corresponding one of the right hingeably retaining members 53.

The right weight segment 626 is disposed leftwardly of the right power segment 625, and has a first right sub-segment 627, and a second right sub-segment 628 opposite to the first right sub-segment 627 in the front-to-rear direction (Y).

The right fulcrum area 622 is configured for pivotally coupling to the support board 10 about a second moving axis (M2) parallel to the first moving axis (M1). In response to the downward movement of the key cap 50, as shown in FIGS. 5 and 6, the right weight segment 626 is moved angularly and upwardly about the second moving axis (M2).

Figure 5:
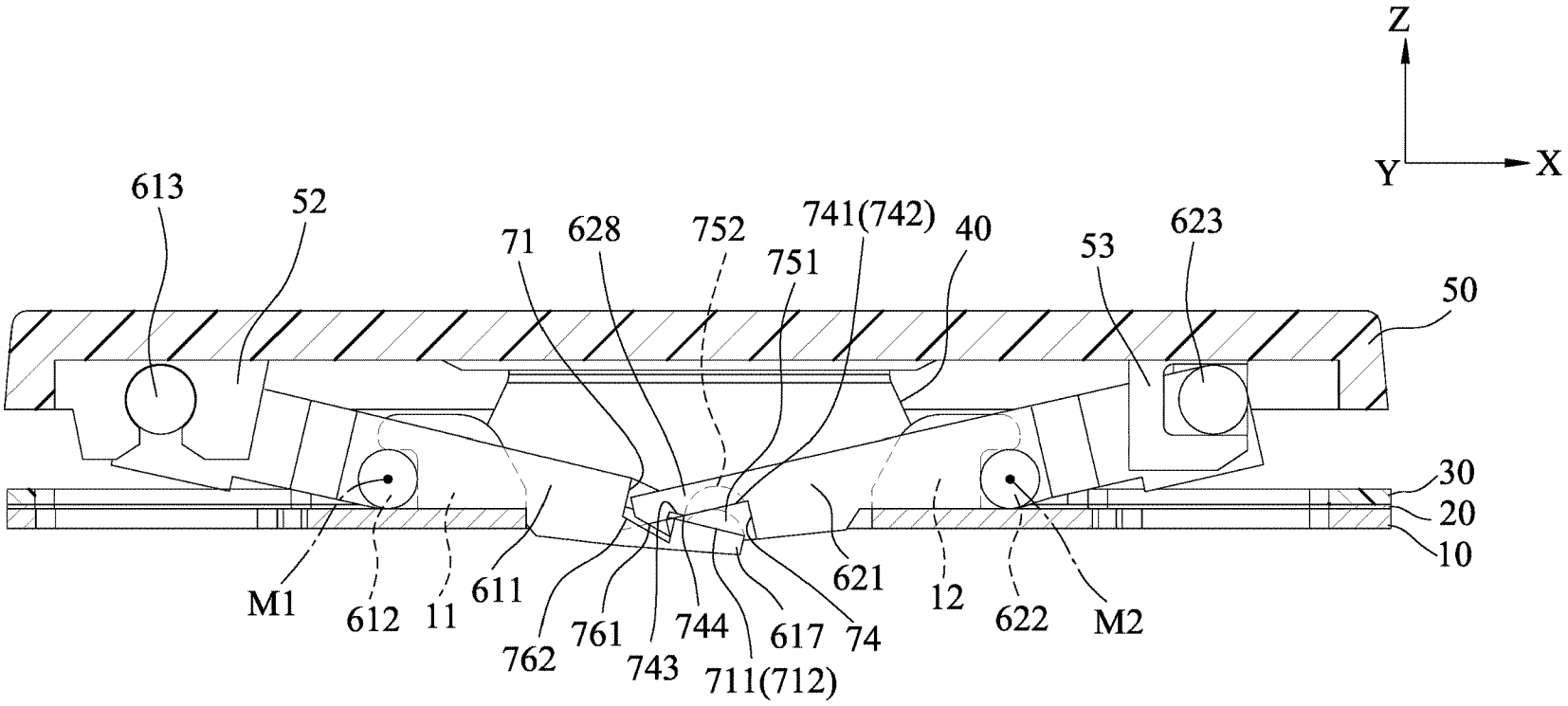
FIG. 5 is a partial cross-sectional view of the key switch device of the first embodiment.
Figure 6:
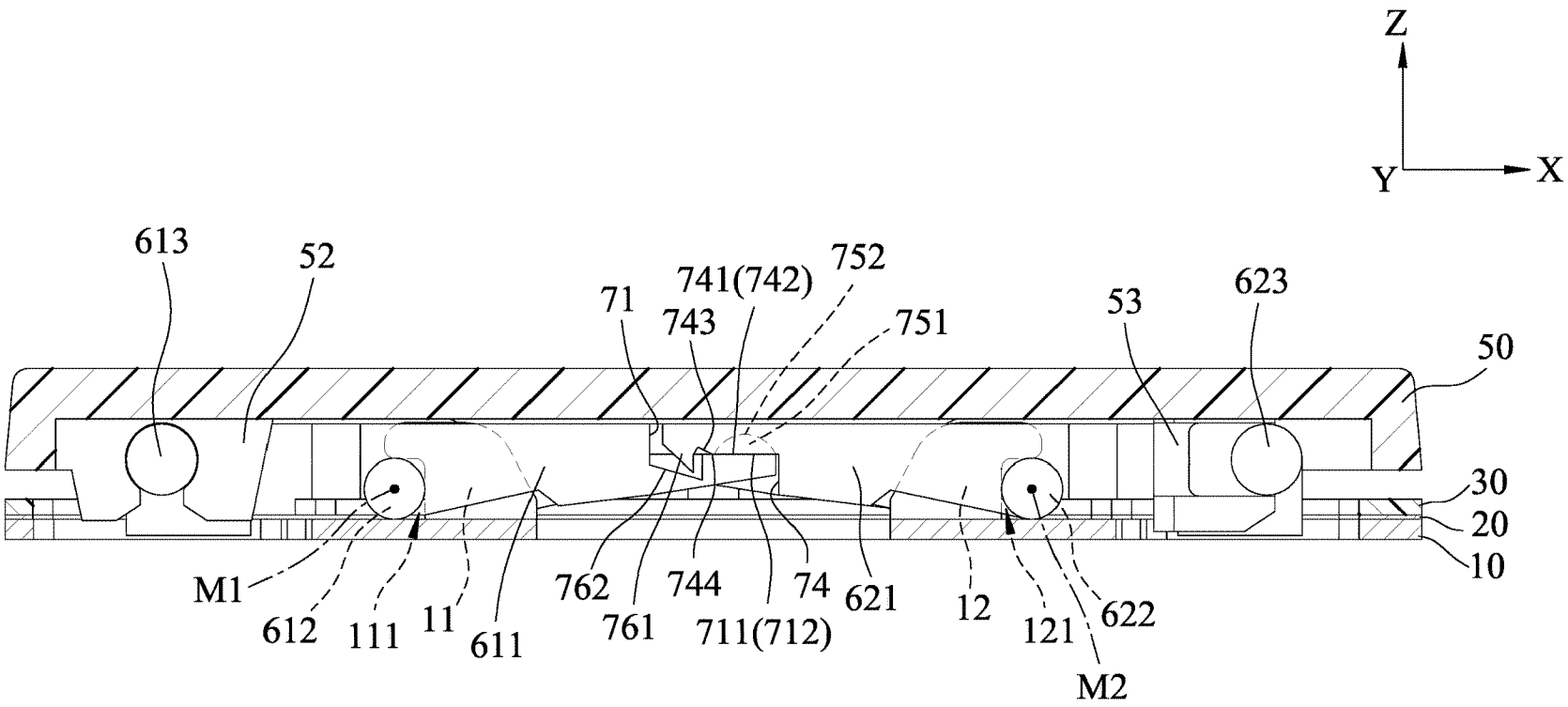
FIG. 6 is similar to FIG. 5 but illustrating the key cap in a pressed position.
Figure 7:
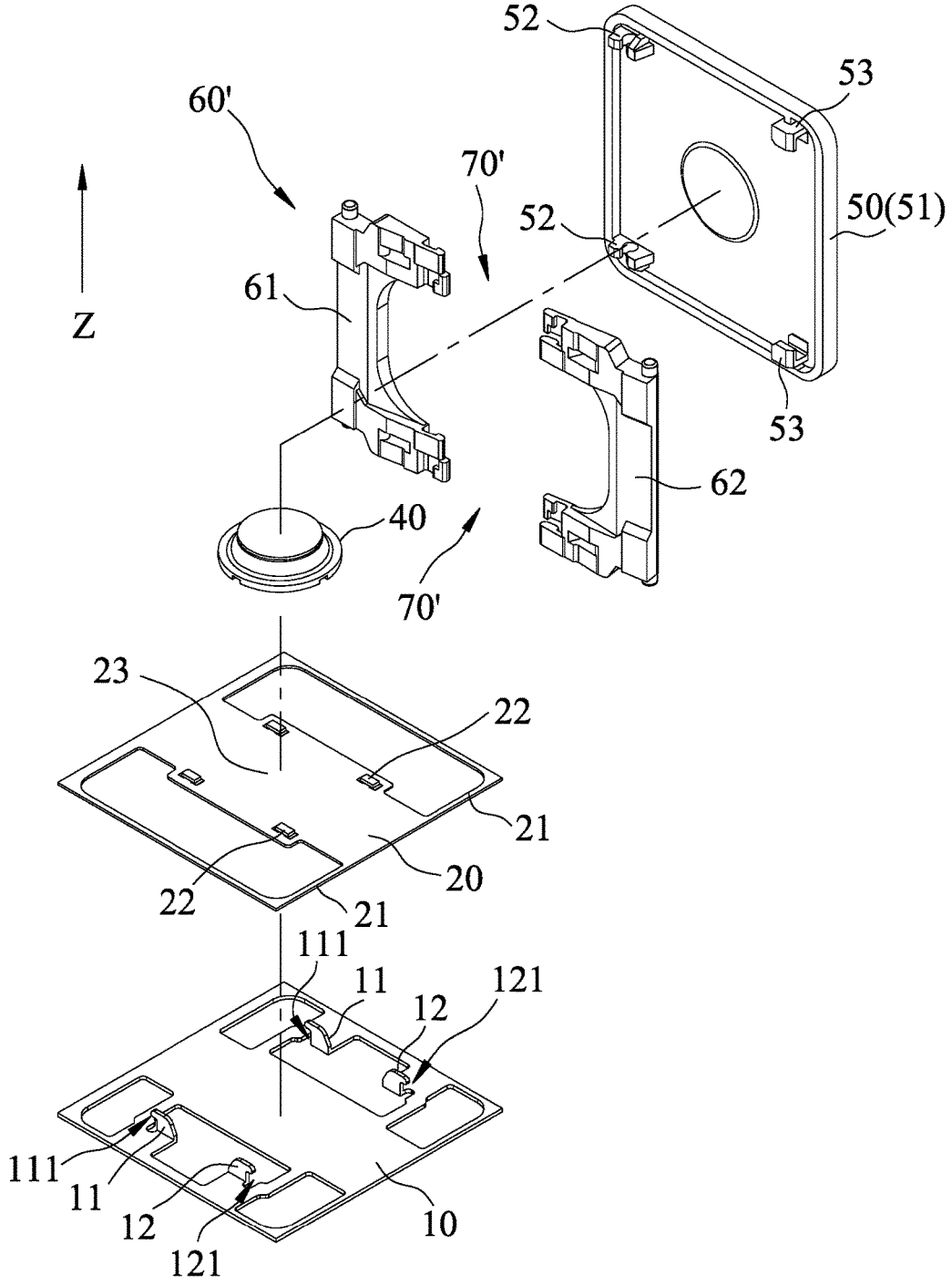
FIG. 7 is an exploded perspective view of a key switch device according to a second embodiment of the disclosure.

In response to the upward movement of the key cap 50, as shown in FIGS. 5 and 6, the right weight segment 626 is moved angularly and downwardly about the second moving axis (M2).

In an embodiment shown in FIGS. 2 and 3, the right fulcrum area 622 may be disposed in a right through bore 624 which is formed in a respective one of the right arms 621, and which is configured to receive a respective one of the right slidably retaining members 12 shown in FIG. 1.

In other embodiments, the right fulcrum area 62 may be formed on an outer peripheral surface of a right fulcrum pin (not shown), and the right fulcrum pin may extend from an outboard of a corresponding one of the right arms 621 in the front-to-rear direction (Y).

The right crosspiece 620 extends in the front-to-rear direction (Y) to interconnect the right power segments 625 of the right arms 621.

As shown in FIGS. 2 and 3, the synchronizing units 70 are configured to couple the left weight segments 616 of the left arms 611 respectively to the right weight segments 626 of the right arms 621 so as to synchronize movement of each of the left arms 611 and a corresponding one of the right arms 621. Each of the synchronizing units 70 includes a left upper cavity 71, a left lower cavity 72, a right upper cavity 73, and a right lower cavity 74.

The left upper cavity 71 is formed in and extends from an upper surface of the first left sub-segment 617 to terminate at a left upward abutment region 711.

The left lower cavity 72 is formed in and extends from a lower surface of the second left sub-segment 618 to terminate at a left downward abutment region 721.

The right upper cavity 73 is formed in and extends from an upper surface of the first right sub-segment 627 to terminate at a right upward abutment region 731 confronting the left downward abutment region 721.

The right lower cavity 74 is formed in and extends from a lower surface of the second right sub-segment 628 to terminate at a right downward abutment region 741 confronting the left upward abutment region 711. In response to the downward movement of the key cap 50, as shown in FIG. 6, the left upward abutment region 711 (also shown in FIG. 2) is brought into frictional engagement with the right downward abutment region 741 (also shown in FIG. 3) to thereby retain the key cap 50 in the pressed position. In response to the upward movement of the key cap 50, the left downward abutment region 721 shown in FIG. 3 is brought into frictional engagement with the right upward abutment region 731 shown in FIG. 2 to thereby retain the key cap 50 in the normal position (FIG. 5).

In a process of assembling, each of the left arms 611 is previously coupled to the respective right arm 621 by virtue of the respective synchronizing unit 70 (i.e., the left and right modular linking members 61, 62 are disposed to permit the left upward and downward abutment regions 711, 721 to respectively confront the right downward and upward abutment regions 741, 731). Next, the left modular linking member 61 is disposed to permit the left slidably retaining members 11 to be respectively received in the left through bores 614 of the left arms 611, and then the left modular linking member 61 is moved rightwardly to permit the left fulcrum areas 612 of the left arms 611 to be slidably retained by the left retaining portions 111, respectively. Thereafter, the right modular linking member 62 is disposed to permit the right slidably retaining members 12 to be respectively received in the right through bores 624 of the right arms 621, and then the right modular linking member 62 is moved leftwardly to permit the right fulcrum areas 622 of the right arms 621 to be slidably retained by the right retaining portions 121, respectively. Because the left and right modular linking members 61, 62 can be previously coupled to each other, the assembling of the key switch device can be more efficient.

In an embodiment shown in FIGS. 2 and 3, the first left sub-segments 617 of the left weight segments 616 of the left arms 611 may be disposed outboard of the second left sub-segments 618 of the left weight segments 616 of the left arms 611. The first right sub-segments 627 of the right weight segments 626 of the right arms 621 may be disposed inboard of the second right sub-segments 628 of the right weight segments 626 of the right arms 621.

In an embodiment shown in FIGS. 2 and 3, the left upward abutment region 711 may have a left distal zone 712 and a left proximate zone 713, which are distal from and proximate to the respective left fulcrum area 612, respectively.

The left downward abutment region 721 may have a left major abutment zone 722, a left marginal zone 723 which is beveled at a first predetermined degree, and a left juncture 724 defined between the left major abutment zone 722 and the left marginal zone 723.

The right upward abutment region 731 may have a right distal zone 732 and a right proximate zone 733, which are distal from and proximate to the respective right fulcrum area 622, respectively. The right distal zone 732 is configured to be brought into frictional engagement with the left major abutment zone 722 in response to the downward movement of the key cap 50. The right proximate zone 733 is configured to be brought into frictional engagement with the left marginal zone 723 in response to the upward movement of the key cap 50.

The right downward abutment region 741 may have a right major abutment zone 742, a right marginal zone 743 which is beveled at a second predetermined degree, and a right juncture 744 defined between the right major abutment zone 742 and the right marginal zone 743. The second predetermined degree is substantially the same as the first predetermined degree. The right major abutment zone 742 is configured to be brought into frictional engagement with the left distal zone 712 in response to the downward movement of the key cap 50 (see FIG. 6). The right marginal zone 743 is configured to be brought into frictional engagement with the left proximate zone 713 in response to the upward movement of the key cap 50 (see FIG. 5).

In an embodiment shown in FIGS. 2, 3, 5, and 6, each of the synchronizing units 70 may further include a first convex area 751 (FIG. 2), a first concave area 752 (FIG. 3), a second convex area 753 (FIG. 2), and a second concave area 754 (FIG. 3).

The first convex area 751 and the first concave area 752 are formed on the left distal zone 712 and the right major abutment zone 742, respectively, and are configured such that in response to the downward movement of the key cap 50, the first convex and concave areas 751, 752 are brought into rotational bearing engagement with each other to facilitate bringing of the left distal zone 712 into frictional engagement with the right major abutment zone 742.

The second convex area 753 and the second concave area 754 are formed on the right distal zone 732 and the left major abutment zone 722, respectively, and are configured such that in response to the downward movement of the key cap 50, the second convex and concave areas 753, 754 are brought into rotational bearing engagement with each other to facilitate bringing of the right distal zone 732 into frictional engagement with the left major abutment zone 722.

In an embodiment shown in FIGS. 2, 3, 5, and 6, each of the first convex and concave areas 751, 752 and second convex and concave areas 753, 754 may have a semicircular cross section in a reference plane extending in the left-to-right direction (X) and the upright direction (Z).

In an embodiment shown in FIGS. 2 and 3, each of the synchronizing units 70 may further include a first hook area 761 (FIG. 3), a first groove area 762 (FIG. 2), a second hook area 763 (FIG. 3), and a second groove area 764 (FIG. 2).

The first hook area 761 and the first groove area 762 are formed on the right marginal zone 743 and the left proximate zone 713, respectively, and are configured such that in response to the upward movement of the key cap 50, the first hook area 761 and the first groove area 762 are brought into hooking engagement with each other to thereby permit the right marginal zone 743 to be in frictional engagement with the left proximate zone 713.

The second hook area 763 and the second groove area 764 are formed on the left marginal zone 723 and the right proximate zone 733, respectively, and are configured such that in response to the upward movement of the key cap 50, the second hook area 763 and the second groove area 764 are brought into hooking engagement with each other to thereby permit the right proximate zone 733 to be in frictional engagement with the left marginal zone 723.

In an embodiment shown in FIGS. 2, 3, 5, and 6, each of the first and second hook areas 761, 763 may have a hook end of a triangle cross-section in the reference plane, and each of the first and second groove areas 762, 764 may have a quadrangular cross-section in the reference plane.

In an embodiment shown in FIGS. 2, 3, 5, and 6, the left juncture 724 may be configured to rotatably abut against the right distal zone 732 during displacement of the key cap 50 so as to reduce a frictional force generated between the right upward abutment region 731 and the left downward abutment region 721. The right juncture 744 may be configured to rotatably abut against the left distal zone 712 during displacement of the key cap 50 so as to reduce a frictional force generated between the left upward abutment region 711 and the right downward abutment region 741.

In an embodiment shown in FIGS. 1 and 2, the key switch device may further include a circuit board 20, an insulating film 30, and an actuating member 40.

The circuit board 20 is disposed on the support board 10 and has a plurality of first openings 21 configured to permit the left and right fulcrum areas 612, 622 of the left and right arms 611, 621 access to the support board 10. The circuit board 20 has an electric contact 23, and may be a membrane circuit or a printed circuit board.

The insulating film 30 is disposed on the circuit board 20, and has a plurality of second openings 31 which are in line with the first openings 21 to permit the left and right fulcrum areas 612, 622 of the left and right arms 611, 621 access to the support board 10. The insulating film 30 further has a central hole 32 for access to the electric contact 23.

The actuating member 40 is elastically deformable and is disposed between the key cap 50 and the insulating film 30 to bias the key cap 50 to the normal position, such that in response to the downward movement of the key cap 50, the actuating member 40 is displaced to trigger the electric contact 23 for producing an electric signal. The actuating member 40 may be any elements for providing a biasing force, such as a rubber dome, a coil spring, etc.

In an embodiment shown in FIG. 1, the key switch device may further include a plurality of light-emitting members 22 which are disposed on the circuit board 20 and which are electrically connected to circuitry in the circuit board 20. The light-emitting members 22 may be light-emitting diodes or the like.

FIGS. 7 to 11 illustrate a key switch device according to a second embodiment of the disclosure. In the second embodiment, the insulating film 30 may be omitted. A linkage assembly 60' of the second embodiment is similar to the linkage assembly 60 of the first embodiment except that the first left sub-segment 617 is disposed forwardly of the second left sub-segment 618, and the first right sub-segment 627 is disposed rearwardly of the second right sub-segment 628.

Furthermore, two synchronizing units 70' of the second embodiment are slightly different from the synchronizing units 70 of the first embodiment. Each of the synchronizing units 70' includes a left upper cavity 71', a left lower cavity 72', a right upper cavity 73', and a right lower cavity 74', which are similar to the left upper cavity 71, the left lower cavity 72, the right upper cavity 73, and the right lower cavity 74, respectively.

Figure 8:
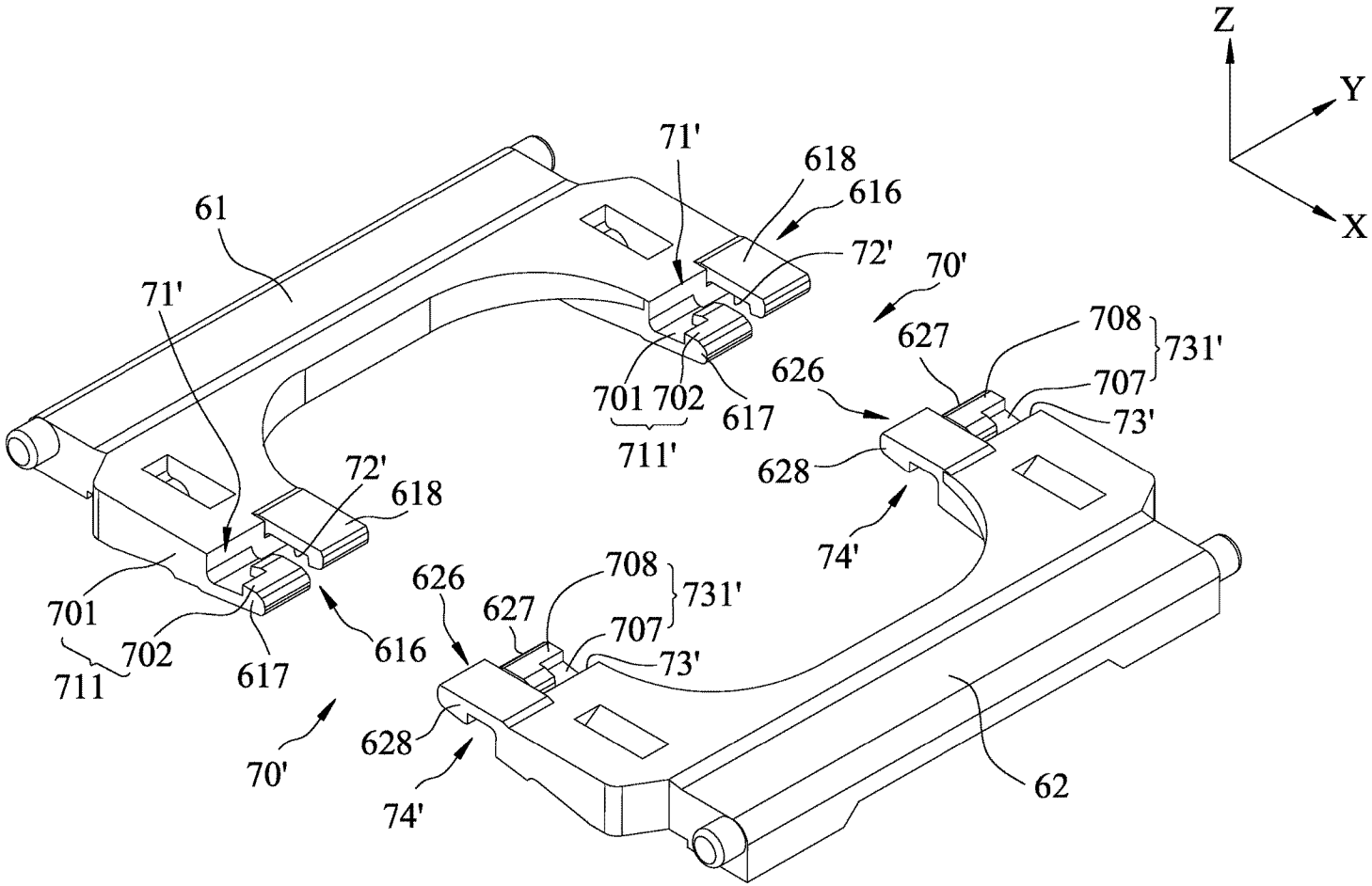
FIG. 8 is an enlarged perspective view of left and right modular linking members of the key switch device of the second embodiment.

As shown in FIG. 8, a left upward abutment region 711' of the left upper cavity 71' has a first depressed area 701, and a first non-depressed area 702 displaced from the first depressed area 701 in the left-to-right direction (X).

Figure 9:
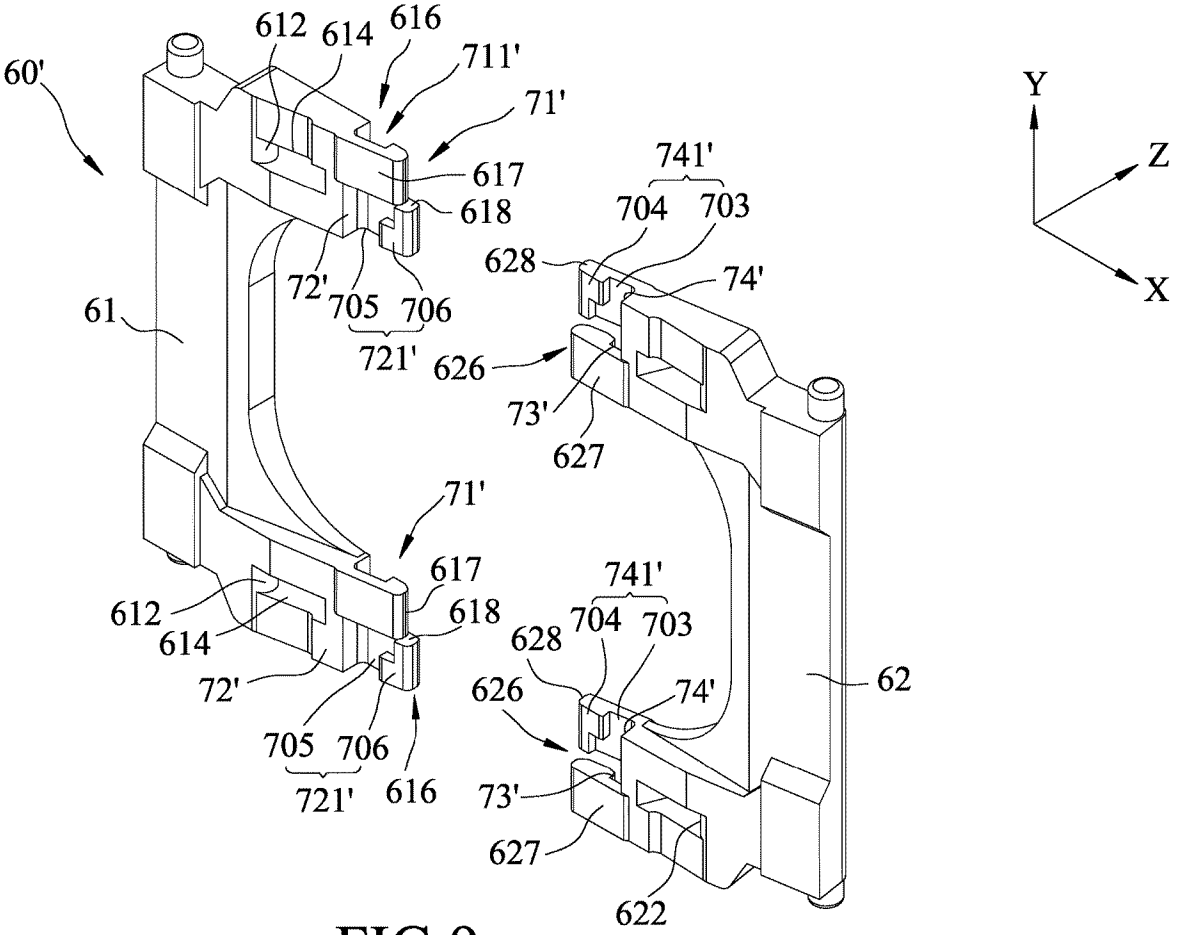
FIG. 9 is similar to FIG. 8 but illustrating the bottoms of the left and right modular linking members.
Figure 10:
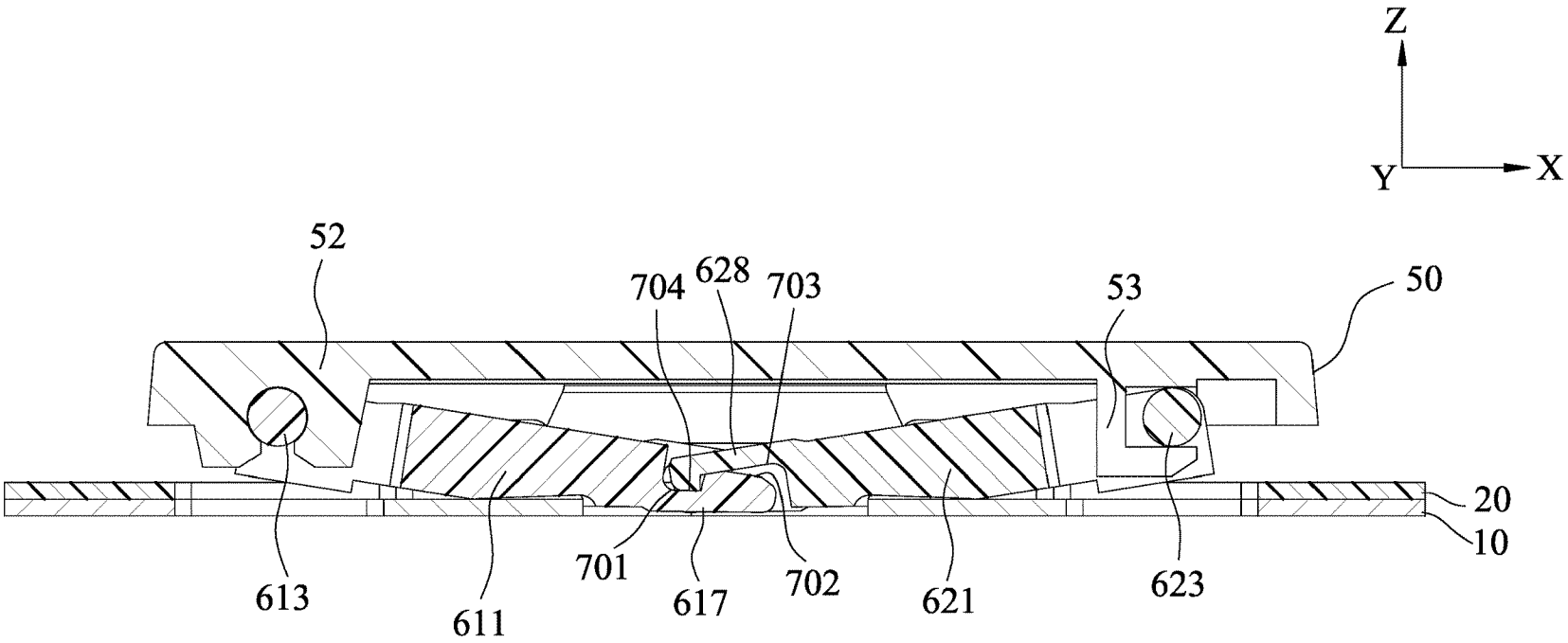
FIG. 10 is a partial cross-sectional view of the key switch device of the second embodiment.
Figure 11:
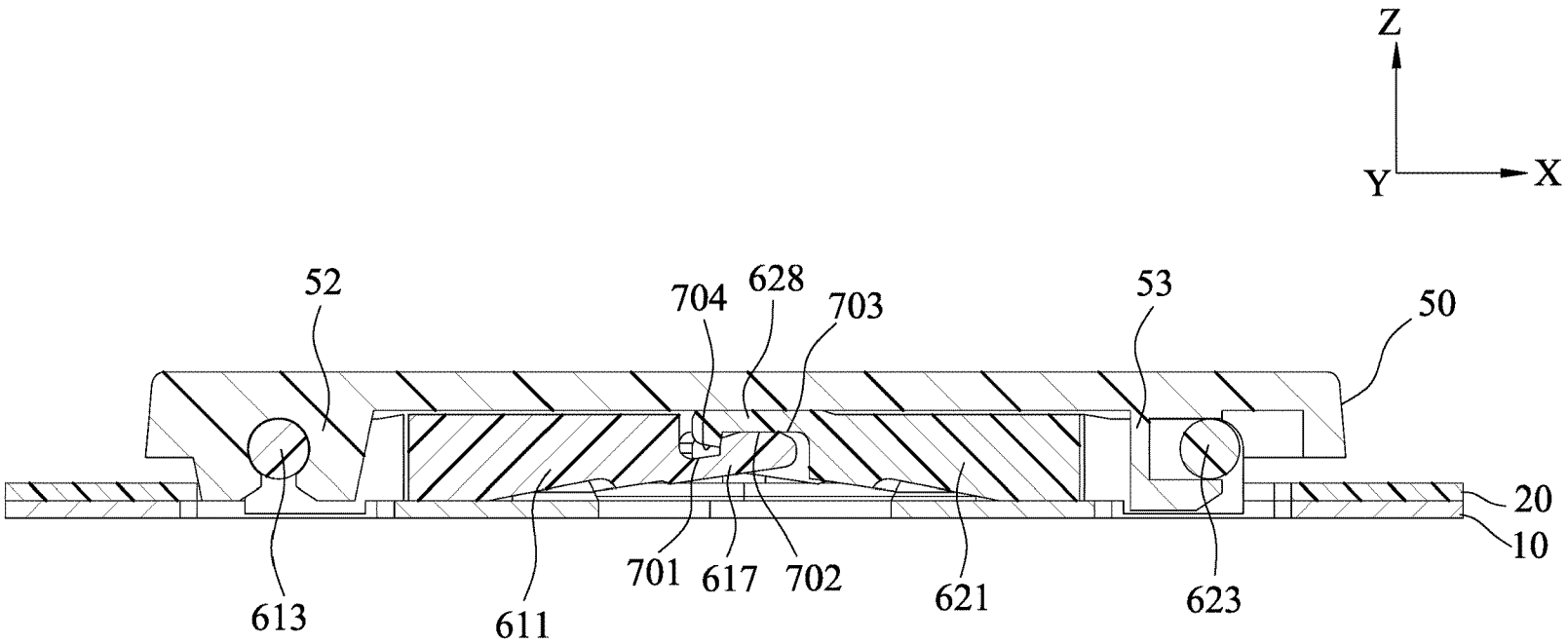
FIG. 11 is similar to FIG. 10 but illustrating a key cap in a pressed position.
Figure 12:
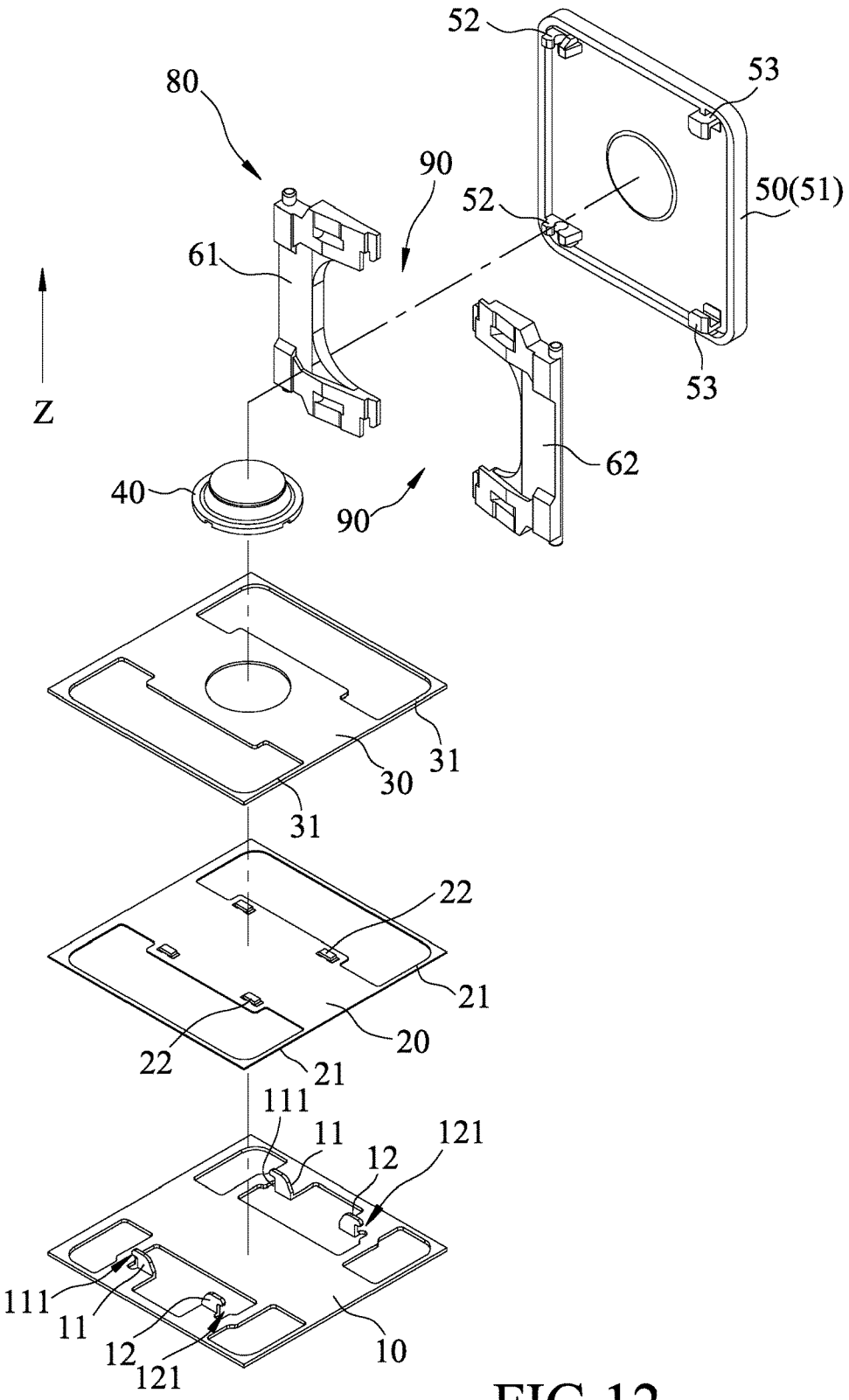
FIG. 12 is an exploded perspective view of a key switch device according to a third embodiment of the disclosure.

As shown in FIG. 9, a right downward abutment region 741' of the right lower cavity 74' has a second depressed area 703, and a second non-depressed area 704 displaced from the first depressed area 703 in the left-to-right direction (X). The second depressed and non-depressed areas 703, 704 are configured to be in rotational bearing engagement with the first non-depressed and depressed areas 702, 701, respectively. In response to the downward movement of the key cap 50 (see FIG. 11), the first non-depressed area 702 is brought into frictional engagement with the second depressed area 703. In response to the upward movement of the key cap 50 (see FIG. 10), the second non-depressed area 704 is brought into frictional engagement with the first depressed area 701.

As shown in FIG. 9, a left downward abutment region 721' of the left lower cavity 72' has a third depressed area 705, and a third non-depressed area 706 displaced from the third depressed area 705 in the left-to-right direction (X).

As shown in FIG. 8, a right upward abutment region 731' of the right upper cavity 73' has a fourth depressed area 707, and a fourth non-depressed area 708 displaced from the fourth depressed area 707 in the left-to-right direction (X). The fourth depressed and non-depressed areas 707, 708 are configured to be in rotational bearing engagement with the third non-depressed and depressed areas 706, 705, respectively. In response to the downward movement of the key cap 50, the fourth non-depressed area 708 is brought into frictional engagement with the third depressed area 705. In response to the upward movement of the key cap 50, the third non-depressed area 706 is brought into frictional engagement with the fourth depressed area 707.

FIGS. 12 to 17 illustrate a key switch device according to a third embodiment of the disclosure. A linkage assembly 80 of the third embodiment is similar to the linkage assembly 60 of the first embodiment except that the first left sub-segment 617 is disposed rearwardly of the second left sub-segment 618, and that the first right sub-segment 627 is disposed forwardly of the second right sub-segment 628.

In addition, two synchronizing units 90 of the third embodiment are slightly different from the synchronizing units 70 of the first embodiment. Each of the synchronizing units 90 includes a left upper cavity 91, a left lower cavity 92, a right upper cavity 93, and a right lower cavity 94, which are similar to the left upper cavity 71, the left lower cavity 72, the right upper cavity 73, and the right lower cavity 74, respectively.

The left upper cavity 91 extends downwardly to terminate at a left upward abutment region 911, the left lower cavity 92 extends upwardly to terminate at a left downward abutment region 921, the right upper cavity 93 extends downwardly to terminate at a right upward abutment region 931, and the right lower cavity 94 extends upwardly to terminate at a right downward abutment region 941.

Figure 13:
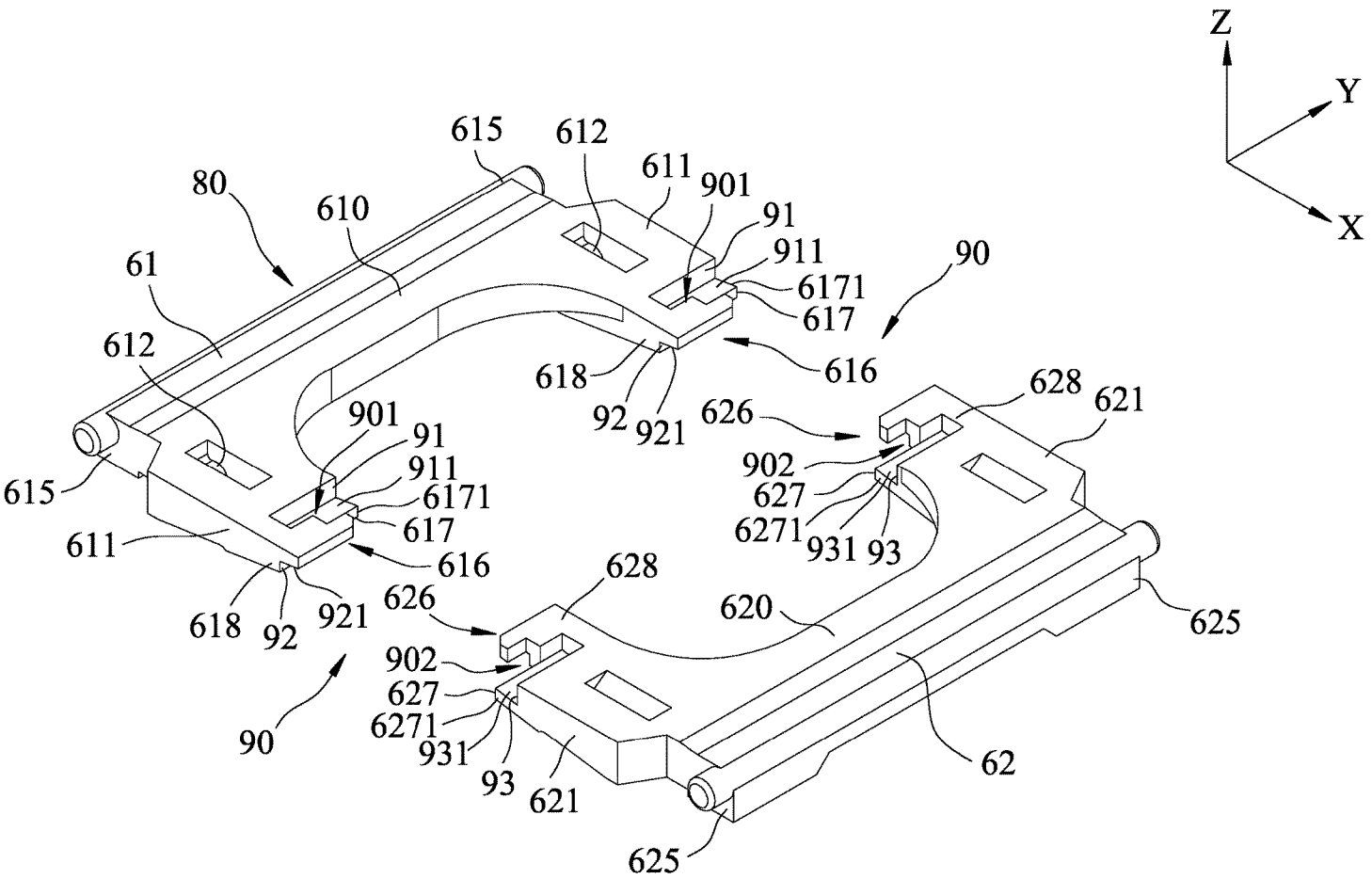
FIG. 13 is an enlarged perspective view of left and right modular linking members of the key switch device of the third embodiment.
Figure 14:
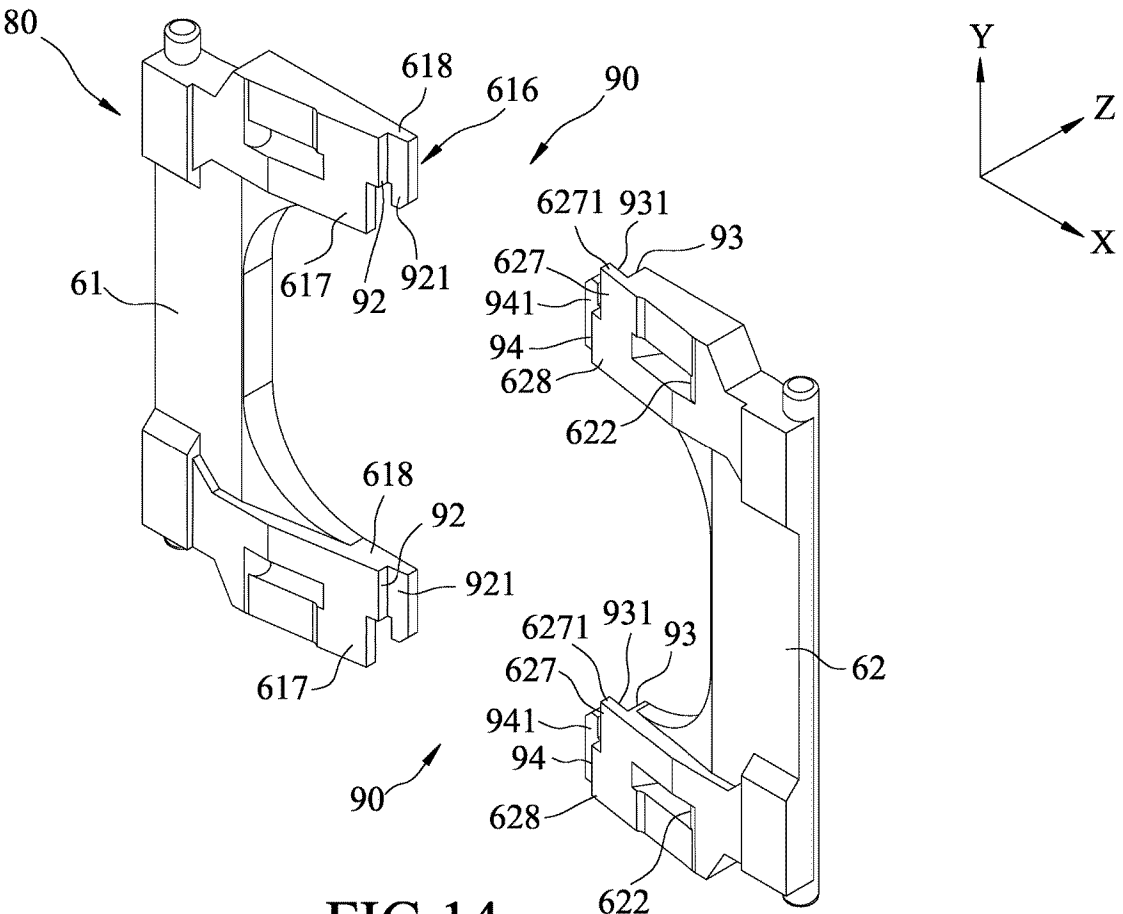
FIG. 14 is similar to FIG. 13 but illustrating the bottoms of the left and right modular linking members.
Figure 15:
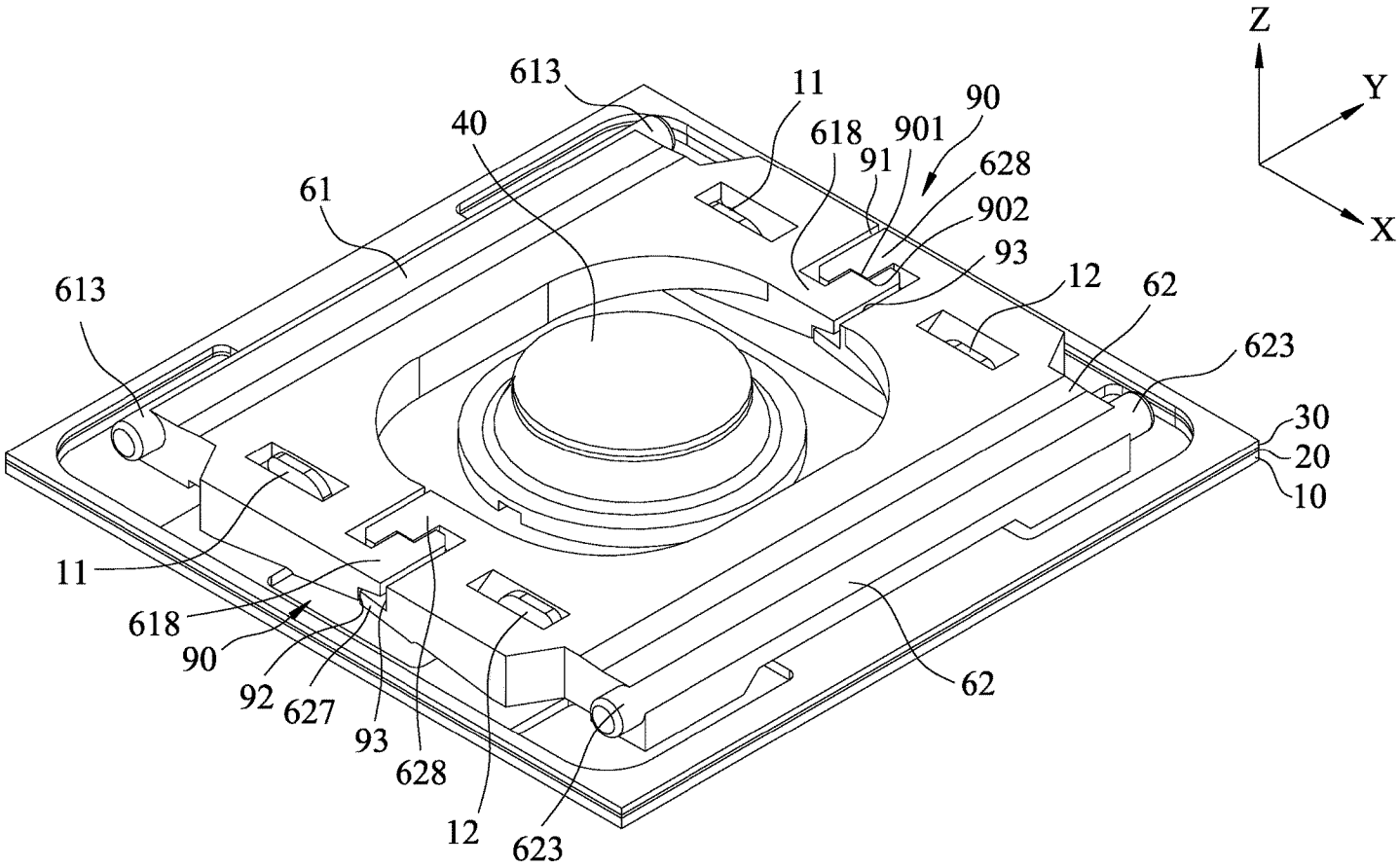
FIG. 15 is a perspective view of the key switch device of FIG. 12 in an assembled state, in which a key cap is omitted.
Figure 16:
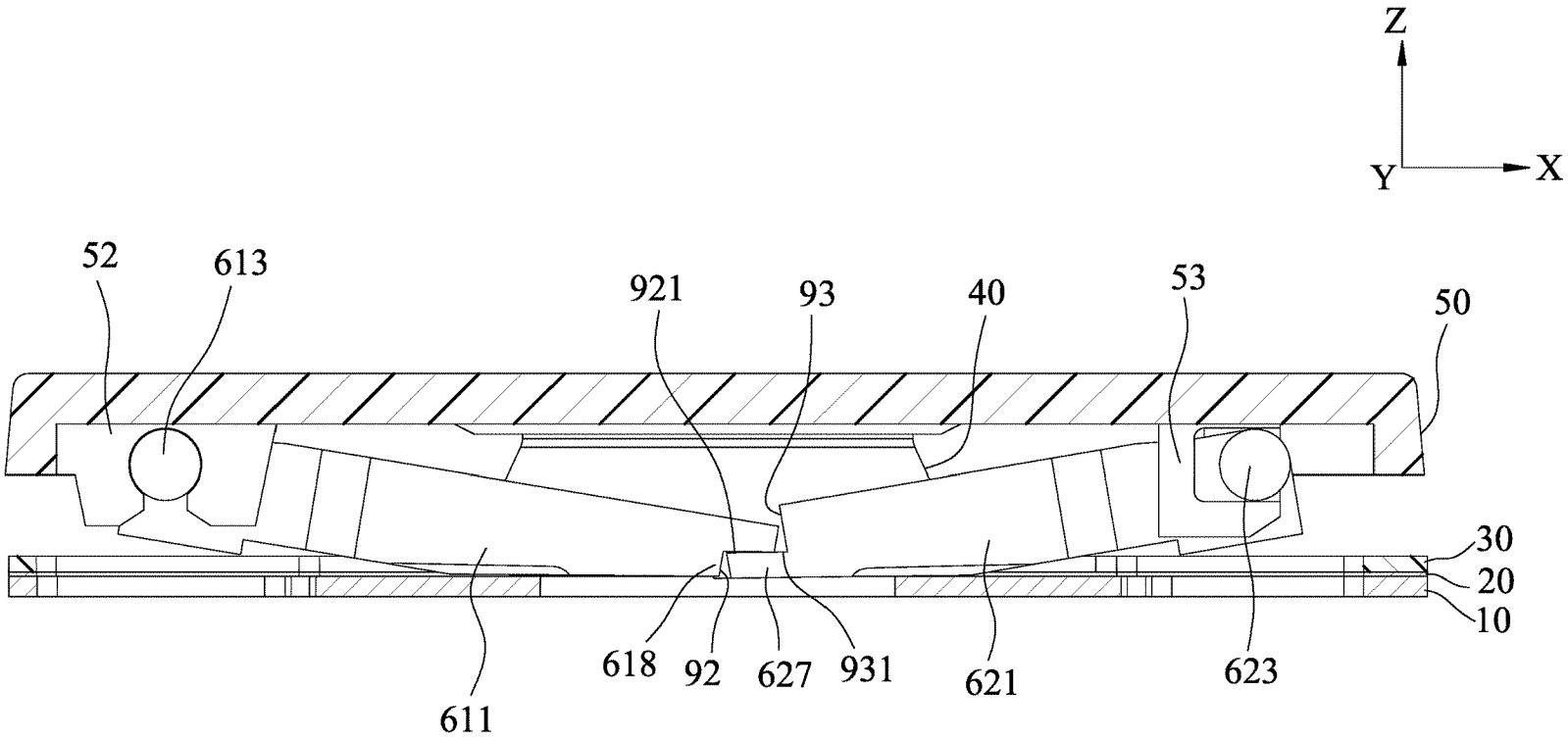
FIG. 16 is a partial cross-sectional view of the key switch device of the third embodiment.
Figure 17:
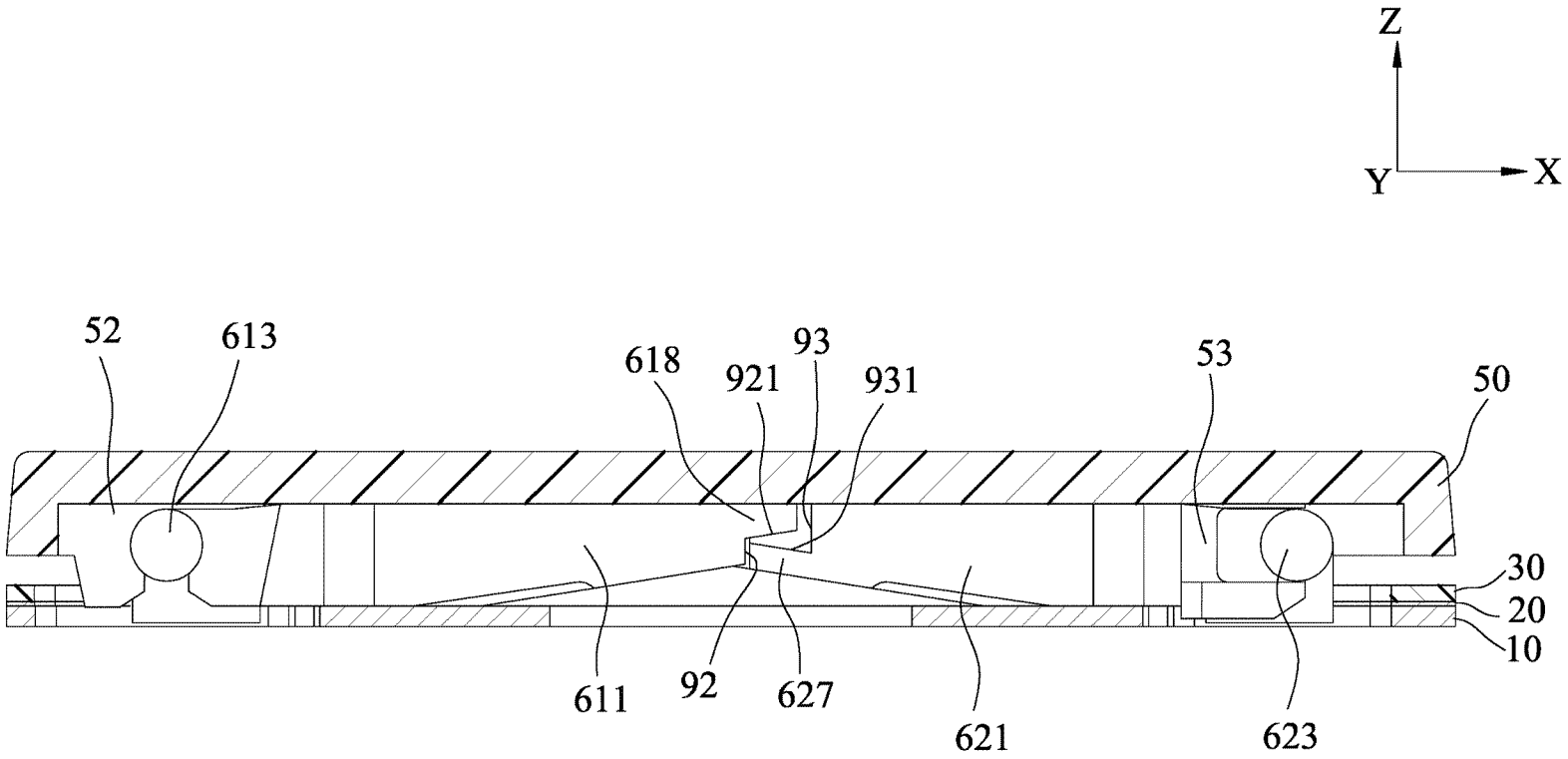
FIG. 17 is similar to FIG. 16 but illustrating the key cap in a pressed position.

In an embodiment shown in FIGS. 13 and 14, the left upper cavity 91 and the left lower cavity 92 may be disposed proximate to and distal from the left fulcrum area 612, respectively, and the right upper cavity 93 and the right lower cavity 94 may be disposed proximate to and distal from the right fulcrum area 622, respectively.

In an embodiment shown in FIGS. 13 and 14, the left upper cavity 91 may extend from a rearward side surface 6171 of the first left sub-segment 617 in the front-to-rear direction (Y) into the second left sub-segment 618 to form a first stepped area 901.

The right upper cavity 93 may extend from a forward side surface 6271 of the first right sub-segment 627 in the front-to-rear direction (Y) into the second right sub-segment 628 to form a second stepped area 902 which is configured to match with and to be in rotational bearing engagement with the first stepped area 901 so as to facilitate bringing of the left upward abutment region 911 into frictional engagement with the right downward abutment region 941 in response to the downward movement of the key cap 50, and so as to facilitate bringing of the left downward abutment region 921 into frictional engagement with the right upward abutment region 931 in response to the upward movement of the key cap 50.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A linkage assembly for guiding movement of a key cap in an upright direction relative to a support board between a normal position, where the keycap is distal from the support board, and a pressed position, where the key cap is proximate to the support board, said linkage assembly comprising:

a left modular linking member including a pair of left arms which are spaced apart from each other in a front-to-rear direction, each of said left arms extending in a left-to-right direction and including a left power segment configured for pivotally coupling with the key cap so as to move therewith in said upright direction, a left weight segment disposed rightwardly of said left power segment, and having a first left sub-segment, and a second left sub-segment opposite to said first left sub-segment in said front-to-rear direction, and a left fulcrum area which is disposed between said left weight segment and said left power segment, and which is configured for pivotally coupling to the support board about a first moving axis in said front-to-rear direction, such that in response to downward movement of the key cap from the normal position to the pressed position, said left weight segment is moved angularly and upwardly about the first moving axis, and such that in response to upward movement of the key cap from the pressed position to the normal position, said left weight segment is moved angularly and downwardly about the first moving axis, and a left crosspiece extending in said front-to-rear direction to interconnect said left power segments of said left arms; and a right modular linking member including a pair of right arms which are spaced apart from each other in said front-to-rear direction, each of said right arms extending in said left-to-right direction and including a right power segment configured for pivotally coupling to the key cap so as to move therewith in said upright direction, a right weight segment disposed leftwardly of said right power segment, and having a first right sub-segment, and a second right sub-segment opposite to said first right sub-segment in said front-to-rear direction, and a right fulcrum area which is disposed between said right weight segment and said right power segment, and which is configured for pivotally coupling to the support board about a second moving axis parallel to the first moving axis, such that in response to the downward movement of the key cap, said right weight segment is moved angularly and upwardly about the second moving axis, and such that in response to the upward movement of the key cap, said right weight segment is moved angularly and downwardly about the second moving axis, and a right crosspiece extending in said front-to-rear direction to interconnect said right power segments of said right arms; and a pair of synchronizing units which are configured to couple said left weight segments of said left arms respectively to said right weight segments of said right arms so as to synchronize movement of each of said left arms and a corresponding one of said right arms, each of said synchronizing units including a left upper cavity which is formed in and extends from an upper surface of said first left sub-segment to terminate at a left upward abutment region, a left lower cavity which is formed in and extends from a lower surface of said second left sub-segment to terminate at a left downward abutment region, a right upper cavity which is formed in and extends from an upper surface of said first right sub-segment to terminate at a right upward abutment region confronting said left downward abutment region, a right lower cavity which is formed in and extends from a lower surface of said second right sub-segment to terminate at a right downward abutment region confronting said left upward abutment region such that in response to the downward movement of the key cap, said left upward abutment region is brought into frictional engagement with said right downward abutment region to thereby retain the key cap in the pressed position, and such that in response to the upward movement of the key cap, said left downward abutment region is brought into frictional engagement with said right upward abutment region to thereby retain the key cap in the normal position.

2. The linkage assembly as claimed in claim 1, wherein said first left sub-segments of said left weight segments of said left arms are disposed outboard of said second left sub-segments of said left weight segments of said left arms, and said first right sub-segments of said right weight segments of said right arms are disposed inboard of said second right sub-segments of said right weight segments of said right arms.

3. The linkage assembly as claimed in claim 1, wherein said left upward abutment region has a left distal zone and a left proximate zone, which are distal from and proximate to said respective left fulcrum area, respectively, said left downward abutment region has a left major abutment zone, a left marginal zone which is beveled at a first predetermined degree, and a left juncture defined between said left major abutment zone and said left marginal zone, said right upward abutment region has a right distal zone and a right proximate zone, which are distal from and proximate to said respective right fulcrum area, respectively, said right distal zone being configured to be brought into frictional engagement with said left major abutment zone in response to the downward movement of the key cap, said right proximate zone being configured to be brought into frictional engagement with said left marginal zone in response to the upward movement of the key cap, and said right downward abutment region has a right major abutment zone, a right marginal zone which is beveled at a second predetermined degree, and a right juncture defined between said right major abutment zone and said right marginal zone, said right major abutment zone being configured to be brought into frictional engagement with said left distal zone in response to the downward movement of the key cap, said right marginal zone being configured to be brought into frictional engagement with said left proximate zone in response to the upward movement of the key cap.

4. The linkage assembly as claimed in claim 3, wherein each of said synchronizing units includes a first convex area and a first concave area, which are formed on said left distal zone and said right major abutment zone, respectively, and which are configured such that in response to the downward movement of the key cap, said first convex and concave areas are brought into rotational bearing engagement with each other to facilitate bringing of said left distal zone into frictional engagement with said right major abutment zone, and a second convex area and a second concave area, which are formed on said right distal zone and said left major abutment zone, respectively, and which are configured such that in response to the downward movement of the key cap, said second convex and concave areas are brought into rotational bearing engagement with each other to facilitate bringing of said right distal zone into frictional engagement with said left major abutment zone.

5. The linkage assembly as claimed in claim 4, wherein each of said synchronizing units includes a first hook area and a first groove area, which are formed on said right marginal zone and said left proximate zone, respectively, and which are configured such that in response to the upward movement of the key cap, said first hook area and said first groove area are brought into hooking engagement with each other to thereby permit said right marginal zone to be in frictional engagement with said left proximate zone, and a second hook area and a second groove area, which are formed on said left marginal zone and said right proximate zone, respectively, and which are configured such that in response to the upward movement of the key cap, said second hook area and said second groove area are brought into hooking engagement with each other to thereby permit said right proximate zone to be in frictional engagement with said left marginal zone.

6. The linkage assembly as claimed in claim 5, wherein said left juncture is configured to rotatably abut against said right distal zone during displacement of the key cap so as to reduce a frictional force between said right upward abutment region and said left downward abutment region, and said right juncture is configured to rotatably abut against said left distal zone during displacement of the key cap so as to reduce a frictional force generated between said left upward abutment region and said right downward abutment region.

7. The linkage assembly as claimed in claim 1, wherein said first left sub-segment is disposed forwardly of said second left sub-segment, and said first right sub-segment is disposed rearwardly of said second right sub-segment.

8. The linkage assembly as claimed in claim 1, wherein said left upward abutment region has a first depressed area, and a first non-depressed area displaced from said first depressed area in said left-to-right direction, said right downward abutment region has a second depressed area, and a second non-depressed area displaced from said first depressed area in said left-to-right direction, said second depressed and non-depressed areas being configured to be in rotational bearing engagement with said first non-depressed and depressed areas, respectively, such that in response to the downward movement of the key cap, said first non-depressed area is brought into frictional engagement with said second depressed area, and such that in response to the upward movement of the key cap, said second non-depressed area is brought into frictional engagement with said first depressed area, said left downward abutment region has a third depressed area, and a third non-depressed area displaced from said third depressed area in said left-to-right direction, and said right upward abutment region has a fourth depressed area, and a fourth non-depressed area displaced from said fourth depressed area in said left-to-right direction, said fourth depressed and non-depressed areas being configured to be in rotational bearing engagement with said third non-depressed and depressed areas, respectively, such that in response to the downward movement of the key cap, said fourth non-depressed area is brought into frictional engagement with said third depressed area, and such that in response to the upward movement of the key cap, said third non-depressed area is brought into frictional engagement with said fourth depressed area.

9. The linkage assembly as claimed in claim 1, wherein said first left sub-segment is disposed rearwardly of said second left sub-segment, and said first right sub-segment is disposed forwardly of said second right sub-segment.

10. The linkage assembly as claimed in claim 9, wherein said left upper cavity and said left lower cavity are disposed proximate to and distal from said left fulcrum area, respectively, and said right upper cavity and said right lower cavity are disposed proximate to and distal from said right fulcrum area, respectively.

11. The linkage assembly as claimed in claim 10, wherein said left upper cavity extends from a rearward side surface of said first left sub-segment in said front-to-rear direction into said second left sub-segment to form a first stepped area, and said right upper cavity extends from a forward side surface of said first right sub-segment in said front-to-rear direction into said second right sub-segment to form a second stepped area which is configured to match with and to be in rotational bearing engagement with said first stepped area so as to facilitate bringing of said left upward abutment region into frictional engagement with said right downward abutment region in response to the downward movement of the key cap, and so as to facilitate bringing of said left downward abutment region into frictional engagement with said right upward abutment region in response to the upward movement of the key cap.

12. A key switch device comprising a key cap, a support board, and a linkage assembly as claimed in claim 1.

* * * * *